United States Patent [19]

Scholl

[11] Patent Number: 4,969,602

[45] Date of Patent: Nov. 13, 1990

[54] NOZZLE ATTACHMENT FOR AN ADHESIVE DISPENSING DEVICE

[75] Inventor: Charles H. Scholl, Duluth, Ga.

[73] Assignee: Nordson Corporation, Westlake, Ohio

[21] Appl. No.: 415,031

[22] Filed: Sep. 29, 1989

Related U.S. Application Data

[63] Continuation-in-part of Ser. No. 268,002, Nov. 7, 1988, abandoned.

[51] Int. Cl.[5] ..... B05B 1/34

[52] U.S. Cl. ..... 239/298; 239/135; 239/406; 239/412; 239/417.3; 239/549; 239/600; 425/7

[58] Field of Search ..... 239/133, 135, 290, 294, 239/296, 298, 406, 411, 412, 417.3, 549, 558, 600; 425/7

[56] References Cited

U.S. PATENT DOCUMENTS

| | | | |
|---|---|---|---|
| 721,900 | 3/1903 | Lassoe et al. | 239/406 |
| 1,960,724 | 5/1934 | Bramsen | 239/411 |
| 2,102,382 | 12/1937 | Roselund | 239/290 |
| 2,626,424 | 1/1953 | Hawthorne, Jr. | 65/5 |
| 2,646,313 | 7/1953 | Peeps | 239/296 |
| 3,053,461 | 9/1962 | Inglis | 239/411 |
| 3,152,923 | 10/1964 | Marshall et al. | 118/324 |
| 3,252,657 | 5/1966 | Winegar | 239/296 |
| 3,764,069 | 10/1973 | Runstadler et al. . | |
| 3,825,379 | 7/1974 | Lohkamp et al. . | |
| 3,841,567 | 10/1974 | Drozek et al. . | |
| 3,920,362 | 11/1975 | Bradt | 425/7 |
| 4,185,981 | 1/1980 | Ohsato et al. | 425/7 |
| 4,219,157 | 8/1980 | Binoche | 239/299 |
| 4,411,389 | 10/1983 | Harrison | 239/600 |
| 4,767,057 | 8/1988 | Degli et al. | 239/296 |
| 4,785,996 | 11/1988 | Ziecker et al. | 239/298 |
| 4,815,660 | 3/1989 | Boger | 239/298 |

FOREIGN PATENT DOCUMENTS

| | | | |
|---|---|---|---|
| 1109198 | 8/1984 | U.S.S.R. | 239/290 |
| 1240465 | 6/1986 | U.S.S.R. | 239/290 |

*Primary Examiner*—Andres Kashnikow
*Assistant Examiner*—Michael J. Forman
*Attorney, Agent, or Firm*—Wood, Herron & Evans

[57] ABSTRACT

An apparatus for dispensing adhesive in an elongated strand or fiber in a controlled, spiral pattern upon a substrate comprises a dispensing device having a nozzle formed with an adhesive delivery passageway and an air delivery passageway both of which terminate at the base of the nozzle. A nozzle attachment in the form of an annular plate is mounted to the base of the nozzle by a cap. The annular plate is formed with a throughbore which receives hot melt adhesive from the adhesive delivery passageway and ejects an adhesive bead through a nozzle tip formed on the outer side of the plate opposite the nozzle. An annular groove formed in the outer side of the plate facilitates drilling of air jet bores therein at an angle relative to the throughbore and adhesive bead ejected therefrom. The air jet bores receive pressurized air from the air delivery passageway in the nozzle and direct jets of pressurized air substantially tangent to the adhesive bead to form an elongated adhesive fiber and to impart a spiral motion to the elongated adhesive fiber so that a compact, spiral pattern is formed for deposition onto a substrate.

11 Claims, 3 Drawing Sheets

NOZZLE ATTACHMENT FOR AN ADHESIVE DISPENSING DEVICE

This application is a continuation-in-part of U.S. patent application Ser. No. 07/268,002, filed Nov. 7, 1988, now abandoned, and entitled "Nozzle Attachment For An Adhesive Spray Gun", which is assigned to the same assignee as this invention.

FIELD OF THE INVENTION

This invention relates to adhesive dispensing devices, and, more particularly, to an adhesive dispensing device having a nozzle attachment for spraying adhesive in an elongated strand or fiber in a controlled spray pattern onto a substrate.

BACKGROUND OF THE INVENTION

Hot melt thermoplastic adhesives have been widely used in industry for adhering many types of products, and are particularly useful in applications where quick setting time is advantageous. One application for hot melt adhesive which has been of considerable interest in recent years is the bonding of nonwoven fibrous material to a polyurethane substrate in articles such as disposable diapers, incontinence pads and similar articles.

One aspect of forming an appropriate bond between the non-woven layer and polyurethane substrate of a disposable diaper, for example, is to avoid loss of adhesive in the valleys or gaps formed in the irregular surface of the chopped fibrous or fluff-type material which forms the non-woven layer. If the adhesive is discharged onto the non-woven layer in droplet form, for example, a portion of the droplets can fall between the gaps in the surface of the fibrous, non-woven material. As a result, additional quantities of adhesive are required to obtain the desired bond strength between the polyurethane substrate and non-woven material.

This problem has been overcome by forming hot melt thermoplastic adhesives in elongated, thin strands or fibers which are deposited atop the nonwoven material and span the gaps in its irregular surface. Elongated strands or fibers of adhesive have been produced in spray devices which include a nozzle formed with an adhesive discharge opening and one or more air jet orifices through which a jet of air is ejected. A bead of adhesive is ejected from the adhesive discharge opening in the nozzle which is then impinged by the air jets to attenuate or stretch the adhesive bead forming a thin fiber for deposition onto the substrate. Examples of spray devices which are capable of dispensing a viscous material in the form of elongated strands or fibers are disclosed in U.S. Pat. No. 2,626,424 to Hawthorne, Jr.; U.S. Pat. No. 3,152,923 to Marshall et al; and, U.S. Pat. No. 4,185,981 to Ohsato et al.

In applications such as the formation of disposable diapers, it is important to carefully control the pattern of the adhesive fiber deposited onto the non-woven substrate in order to obtain the desired bond strength between the non-woven layer and polyurethane substrate using as little adhesive as possible. Improved control of the pattern of adhesive fibers has been obtained in dispensing devices of the type described above by impacting the adhesive bead discharged from the nozzle with air jets directed substantially tangent to the adhesive bead. The tangentially applied air jets control the motion of the elongated fiber of adhesive formed from the adhesive bead ejected from the adhesive discharge opening in the gun nozzle, and confine the elongated fiber in a relatively tight, or compact, spiral pattern for application onto the substrate. Structure which produces a spiral pattern for deposition onto a substrate is disclosed, for example, in the '424 Hawthorne, Jr. patent and the '981 Ohsato et al patent mentioned above.

In order to produce a compact spiral spray pattern of adhesive fibers in the dispensing devices described above, it is important to ensure that the air jets are directed tangentially relative to the bead of adhesive ejected from the nozzle of the dispensing device. This requires accurate placement of the bores or passageways through which pressurized air is ejected from the nozzle or gun body of the dispensing device, which are typically on the order of about 0.015 to 0.020 inches in diameter. The boring or drilling of passageways having such a small diameter at the appropriate angles in the nozzle and/or gun body of prior art dispensing devices is a relatively expensive and difficult machining operation.

Many problems with prior art adhesive fiber dispensing systems have been overcome by the nozzle attachment disclosed in U.S. Pat. No. 4,785,996, which is assigned to the same assignee as this invention. The nozzle attachment disclosed in U.S. Pat. No. 4,785,996 is adapted to mount to the nozzle of a standard adhesive gun which is formed with an adhesive discharge opening connected to an adhesive passageway in the gun body and an air discharge opening connected to an air passageway in the gun body. The nozzle attachment is a one-piece annular plate formed with a boss extending outwardly from a first surface of the plate and a nozzle tip extending outwardly from a second surface of the plate. A throughbore is formed between the boss and nozzle tip which communicates with the adhesive discharge opening in the nozzle of the gun body when the plate is mounted to the nozzle. Heated hot melt adhesive is transmitted through the adhesive passageway in the gun body, out its adhesive discharge opening and then into the throughbore in the plate. The adhesive is ejected as a bead through the nozzle tip toward a substrate.

The nozzle attachment is formed with an annular notch or groove which extends from its first surface having the boss toward the second surface formed with the nozzle tip. The annular groove is provided to assist in drilling air jet bores in the plate through which jets of pressurized air are directed at an angle of about 30° and tangent to the adhesive bead ejected from the nozzle tip. One surface of the annular groove is oriented substantially perpendicular to the axis of movement of the drill bit, i.e., at an angle of about 30° to the first and second surfaces of the plate, and sufficient clearance is provided within the annular groove to avoid interference with the drill bit. As a result, sliding of the drill bit relative to the plate is minimized during the drilling or boring operation which helps locate the air jets bores at the desired angle in the plate.

While the nozzle attachment disclosed in U.S. Pat. No. 4,785,996 solves many of the problems of prior art devices designed to spray viscous material such as hot melt adhesive, some deficiencies have been discovered in certain applications. It has been found that the formation of a groove in the relatively thin nozzle attachment or plate can result in deflection of the nozzle attachment during operation, particularly where the threaded mounting nut which mounts the nozzle attachment in place on the nozzle is secured with too much torque. This deflection can form a leakage path at the interface between the nozzle attachment and nozzle of the spray gun. In some instances, it has been found that hot melt adhesive entering the nozzle attachment has flowed along this leakage path and been deposited in the annular groove where the air flows into the air jet bores. This can clog the air jet bores and restrict the flow of air necessary to attenuate or stretch the adhesive bead to form adhesive fibers.

Another potential problem with the nozzle attachment of U.S. Pat. No. 4,785,996 is that the air jet bores are drilled in the plate or nozzle attachment from the inner side or surface which contacts the nozzle toward the outer side or surface formed with the nozzle tip. Because the air jet bores are so small in diameter, i.e., 0.015 to 0.020 inches, it is possible for the drill bit to drift or move off line in the course of passing through the nozzle attachment from its inner side to the outer side. As a result, the discharge outlet of the air jet bores at the outer side of the nozzle attachment might be slightly out of position and this can affect the efficiency of the nozzle attachment in forming adhesive fibers because the air jets may not impact the adhesive bead precisely tangentially thereto.

The nozzle tip of the nozzle attachment disclosed in U.S. Pat. No. 4,785,996 protrudes from the outer surface thereof when mounted to the nozzle of the gun body, and extends outwardly from the mounting nut which secures the nozzle attachment to the nozzle of the spray gun. A cavity or space is thus formed between the nozzle tip and such mounting nut. When the spray gun is operated intermittently, it has been found that cut-off drool, i.e., adhesive remaining after the gun is shut off, can collect in the space or cavity between the nozzle tip and mounting nut. This cut-off drool might collect and partially block the discharge outlet of the air jet bores formed in the nozzle attachment, thus affecting the performance of the nozzle attachment in forming adhesive fibers. Additionally, the protruding nozzle tip is exposed and can be damaged if it contacts the target substrate or other object during operation of the spray gun.

SUMMARY OF THE INVENTION

It is therefore among the objectives of this invention to provide a nozzle attachment for use in a gun for dispensing adhesive in an elongated strand or fiber onto a substrate which is relatively inexpensive to manufacture, which provides accurately located air jets to attenuate or stretch an adhesive bead to form an elongated adhesive fiber, which avoids leakage of adhesive from the dispensing device, which is rugged in construction, which resists clogging with adhesive and which is readily installed on a standard gun to convert the gun to one capable of spraying hot melt adhesive in fiber form.

These objectives are accomplished in a nozzle attachment adapted for use with an adhesive dispensing device which includes a gun body and a nozzle having an adhesive passageway and an air passageway. The nozzle attachment is a one-piece annular plate which is mounted by a cap or nut to the nozzle of the gun body. The nozzle attachment or plate is formed with a throughbore adapted to connect to the adhesive passageway in the nozzle, and a plurality of spaced air jet bores are formed in the plate which communicate with the air passageway in the nozzle. An adhesive bead is ejected from the throughbore in the plate which is impacted by air jets from the spaced air jet bores. The air jets are directed tangentially to the bead to both stretch the bead forming an elongated adhesive fiber, and to impart a spiral motion to the adhesive fiber so that it is deposited in a controlled spray pattern upon a substrate.

The one-piece annular plate is formed with a boss extending outwardly from a first, inner surface of the plate, and a nozzle tip extending inwardly from a second, outer surface of the plate toward its inner surface. A throughbore is formed in the plate between the boss and nozzle tip which communicates with the adhesive passageway in the nozzle when the plate is mounted thereto. Adhesive is transmitted through the nozzle and then into the throughbore in the plate from which it is ejected through a discharge outlet of the nozzle tip toward a substrate.

The annular plate of this invention is relatively thick, i.e., in a direction from its inner surface, to its outer surface in order to resist deflection with respect to the nozzle during operation of the spray gun and when the nozzle attachment is secured to the nozzle by a mounting nut or the like. The inner surface of the plate has a flat or planar portion which forms an effective metal-to-metal seal with the mating surface of the nozzle of the spray gun when the plate is mounted thereto. As a result, adhesive transmitted from the nozzle into the throughbore of the plate is prevented from leaking at the interface therebetween.

The annular plate forming the nozzle attachment of this invention is formed with an annular, substantially V-shaped notch or groove which extends inwardly from the outer surface of the plate toward its inner surface. This annular groove is provided to assist in the drilling operation of air jet bores through which jets of pressurized air are directed from the air passageway in the nozzle, through the plate and then into contact with the adhesive bead ejected from the discharge outlet of the nozzle tip.

In the presently preferred embodiment, each of the spaced air jet bores is drilled at an angle of approximately 30° with respect to the longitudinal axis of the throughbore in the plate from which the adhesive bead is ejected. In order to assist in drilling the air jet bores at this angle, one of the sidewalls of the annular groove is oriented substantially perpendicularly to the longitudinal axis of each of the air jet bores. This permits a drill bit to contact the plate at a surface which is substantially perpendicular to the axis of movement of the drill bit, even though the drill bit is moved at a 30° angle with respect to the outer surface of the plate. Another sidewall of the annular groove forms the outer surface of the nozzle tip such that the discharge outlet of the nozzle tip is substantially coplanar with the outer surface of the plate.

The air jet bores formed in the nozzle attachment of this invention are drilled by movement of a drill bit from the outer surface of the nozzle attachment where the annular groove is formed, toward the inner surface of the nozzle attachment which contacts the nozzle. As mentioned above, it is important that the outlet of the air jet bores be precisely located so that the air jets discharged therefrom tangentially impact the adhesive bead discharged from the nozzle tip of the nozzle attachment. Because the drilling operation begins at the outer surface of the nozzle attachment, the location of the outlet of the air jet bores at such outer surface can be precisely controlled. Any drift of the drill bit in moving through the nozzle attachment has no effect on the location of the outlet of the air jet bores at the outer surface of the plate. This had sometimes presented a problem in the machining of the nozzle attachment disclosed in U.S. Pat. No. 4,785,996 wherein the drilling operation proceeded from the inner surface of the plate toward the outer surface.

In a presently preferred embodiment, the spaced air jet bores are also formed in the plate at an angle relative to the outer periphery of the throughbore and the adhesive bead ejected therefrom. The longitudinal axis of each air jet bore is oriented at an angle of approximately 10° with respect to a vertical plane which passes through the longitudinal axis of the throughbore in the plate and the center of such air jet bore at the annular groove in the plate. As a result, the jets of pressurized air ejected from the spaced air jet bores impact the adhesive bead discharged from the nozzle tip of the plate at its outer periphery so as to impart a rotational movement to the bead. The adhesive bead is attenuated or stretched into an elongated fiber upon impact with the air jets, and this fiber is then rotated by the air jets in a spiral motion to control the width of the spray pattern applied to the substrate.

In one embodiment of this invention, the air jet bores formed in the plate extend from the annular groove at the outer surface of the plate to its planar inner surface. Each of the air jet bores form an air inlet at the inner surface of the plate which communicates with the air passageway formed in the nozzle of the spray gun. It has been found that in certain applications, air flow from the air passageway in the nozzle into each of the air jets in the nozzle attachment might be somewhat less than that desired to effectively attenuate or stretch the adhesive bead discharged from the nozzle attachment and to impart a swirling or twisting motion to such elongated fiber for deposition on the substrate. In order to improve the air flow between the nozzle and nozzle attachment, an alternative embodiment of this invention is provided wherein a second annular groove is formed in the nozzle attachment which extends inwardly from the inner surface thereof and intersect each of the air jet bores. In this embodiment, the inlet of each air jet bore is formed at the second annular groove on the inner surface of the nozzle attachment so that the air flow from the air passageway in the nozzle is directed into the annular groove and then into each of the air jet bores for passage through the nozzle attachment. It has been found that this second annular groove on the opposite or inner surface of the nozzle attachment improves the air flow characteristics of the nozzle attachment so that the adhesive bead discharged therefrom is properly attenuated or stretched to form a relatively thin, elongated fiber and such fiber is rotated or twisted to form the desired spiral pattern upon the substrate. In addition, the second annular groove avoids the formation of a chip at the outlet at each air jet bore, i.e., the outlet of each such bore is formed with a uniform, circular cross section because the drill bit exits the plate at a surface of the second annular groove which is substantially perpendicular to the axis of movement of the drill bit.

In the presently preferred embodiment, an annular recess is formed in the nozzle attachment or plate which extends inwardly at the peripheral edge of the plate from its outer surface toward the inner surface. This annular recess forms a seat which receives the mounting nut or cap which mounts the nozzle attachment to the nozzle of the spray gun. Preferably, the outer surface of the nozzle attachment and the discharge outlet of the nozzle tip are coplanar with the mounting cap or nut when the nozzle attachment is mounted to the spray gun nozzle.

This construction has two advantages. First, there is no space or cavity formed between the mounting nut and nozzle tip in which cut-off drool or strands of adhesive could collect to block the air jet bores. This had been a problem in the aforementioned U.S. Pat. No. 4,785,996 wherein a gap was formed between the nozzle tip and mounting nut. Secondly, the mounting nut, the outer surface of the nozzle attachment and the discharge outlet of the nozzle tip are all coplanar. This prevents the nozzle tip from contacting the substrate or another object during operation of the gun where it could be damaged.

The nozzle attachment or plate of this invention provides an economical means to convert a standard adhesive dispensing device into one in which adhesive may be discharged in an elongated strand or fiber for applications such as bonding the non-woven and polyurethane layers of disposable diapers or other hygienic articles. The construction of the nozzle attachment prevents leakage of adhesive at its interface with the nozzle, facilitates the accurate drilling of air jet bores so that the adhesive bead discharged from the spray device is consistently formed into an elongated fiber and resists clogging from build-up of cut-off drool. The nozzle attachment is easily removed from the nozzle and replaced with another nozzle attachment of different size to accommodate different applications and/or different dispensing devices.

DETAILED DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
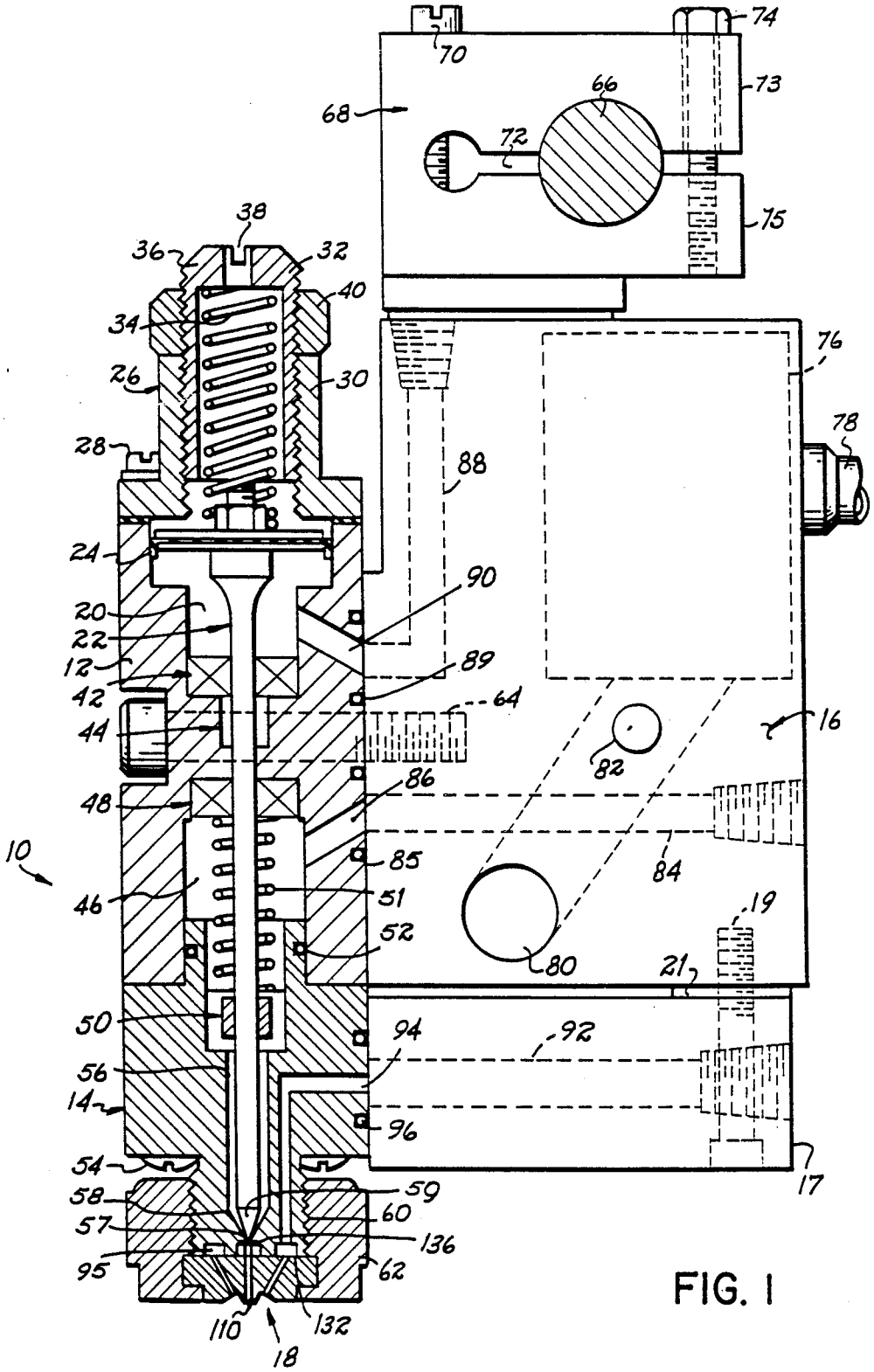
FIG. 1 is a cross sectional view of a spray gun incorporating the nozzle attachment herein with a schematic view of a manifold mounted to the spray gun.

Referring now to FIG. 1, an adhesive dispensing device 10 is illustrated comprising a gun body 12 having a nozzle 14 connected at one end, and an adhesive manifold 16 and air manifold 17 mounted to the gun body 12. The air manifold 17 is mounted to the adhesive manifold 16 by two or more screws 19, each of which extend through a spacer 21 extending between the manifolds 16, 17. The nozzle 14 supports a nozzle attachment 18 from which a bead of heated hot melt adhesive is discharged and formed into a thin, elongated bead or fiber which is rotated in a compact spiral spray pattern onto a substrate, as discussed in detail below. The structure of the gun body 12 and manifolds 16, 17 are substantially identical to the Model H200 spray gun manufactured and sold by the assignee of this invention, Nordson Corporation of Amherst, Ohio. These elements form no part of the invention per se and are thus discussed only briefly herein.

As shown in FIG. 1, the upper portion of gun body 12 is formed with an air cavity 20 which receives the upper end of a plunger 22 mounted to a seal 24. The seal 24 is slidable within the air cavity 20 and provides an airtight seal along its walls. A collar 26 is mounted to the upper end of gun body 12, such as by bolts 28, which is formed with a throughbore defining an inner, threaded wall 30. The collar 26 receives a plug 32 having external threads which mate with the threaded wall 30 of the collar 26. The plug 32 is hollow and a spring 34 is mounted in its interior which extends between the top end of the plunger 22 and the head 36 of plug 32 having a screw slot 38. A lock nut 40 is threaded onto the plug 32 into engagement with the top edge of the collar 26.

The plug 32 is rotatable with respect to the collar 26 to vary the force applied by the spring 34 against the top edge of plunger 22. In order to rotate the plug 32, the lock nut 40 is first rotated to disengage the collar 26 after which a screwdriver is inserted into the screw slot 38 in the head 36 of plug 32 and rotated to move the plug 32, and in turn increase or decrease the compression force of spring 34 within the collar 26.

The plunger 22 is sealed at the base of the air cavity 20 by a seal 42 which permits axial movement of the plunger 22 therealong. The plunger 22 extends downwardly through the gun body 12 from the air cavity 20 through a stepped bore 44 which leads into an adhesive cavity 46 having a seal 48 at its upper end and a plunger mount 50 at its lower end. A spring 51 carried around the plunger 22 is disposed within the adhesive cavity 46 and extends between the seal 48 and plunger mount 50 to hold the seal 48 in place. This seal 48 and seal 42 aid in guiding the axial movement of plunger 22 within the gun body 12.

The upper end of the nozzle 14 extends into the adhesive cavity 46 and is sealed thereto by an 0-ring 52. The nozzle 14 is fixed to the gun body 12 by screws 54. The plunger 22 extends downwardly from the adhesive cavity 46 and plunger mount 50 into an adhesive passageway 56 formed in the nozzle 14 which terminates at an adhesive discharge opening 57. Immediately upstream from the adhesive discharge opening 57, the adhesive passageway 56 is formed with a conical-shaped seat 58 which mates with the terminal end 59 of the plunger 22. As discussed below, movement of the plunger 22 relative to the seat 58 controls the flow of heated hot melt adhesive ejected from adhesive passageway 56 through its adhesive discharge opening 57.

The nozzle 14 is also formed with a reduced diameter portion having external threads 60 which mate with internal threads formed in a cap 62. As described below, the cap 62 mounts the nozzle attachment 18 to the base of nozzle 14 in communication with the discharge opening 57 of adhesive passageway 56.

The gun body 12 is mounted to the adhesive manifold 16 by mounting bolts 64. In turn, the adhesive manifold 16 is supported on a bar 66 by a mounting block 68 connected to the adhesive manifold 16 with screws 70. As illustrated at the top of FIG. 1, the mounting block 68 is formed with a slot 72 forming two half sections 73, 75 which receive the bar 66 therebetween. A bolt 74 spans the half sections 73, 75 of the mounting block formed by the slot 72 and tightens them down against the bar 66 to secure the mounting block 68 thereto.

The adhesive manifold 16 is formed with a junction box 76 which receives an electric cable 78 to supply power to a heater 80 and an RTD 82. The heater 80 maintains the hot melt adhesive in a molten state when it is introduced into the adhesive manifold 16 through an adhesive inlet line 84 from a source of hot melt adhesive (not shown). The adhesive inlet line 84 communicates through a connector line 86 formed in the gun body 12 with the adhesive cavity 46. An 0-ring 85 is provided between the gun body 12 and adhesive manifold 16 at the junction of the adhesive inlet line 84 and connector line 86 to form a seal therebetween. Operating air for the plunger 22 is supplied through an inlet line 88 formed in the adhesive manifold 16 which is joined by a connector line 90 to the air cavity 20. The gun body 12 and manifold are sealed thereat by an 0-ring 89.

The air manifold 17 is formed with an air inlet line 92 connected to an air delivery passageway 94 formed in the nozzle 14 which terminates in an annular chamber 95 at the base of the nozzle 14. 0-ring seal 96 forms a fluid-tight seal between the nozzle 14 and air manifold 17 at the intersection of air inlet line 92 and air delivery passageway 94.

Figure 2:
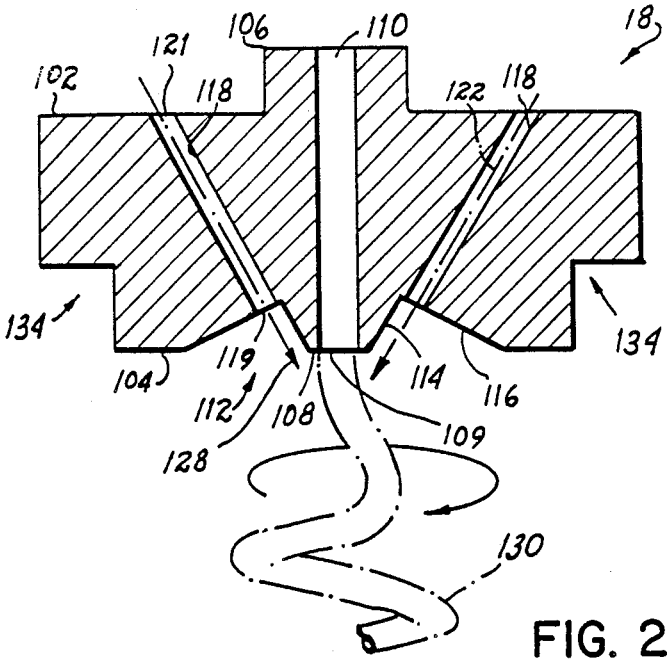
FIG. 2 is an enlarged cross sectional view of the nozzle attachment herein showing an adhesive bead impacted by air jet streams.
Figure 3:
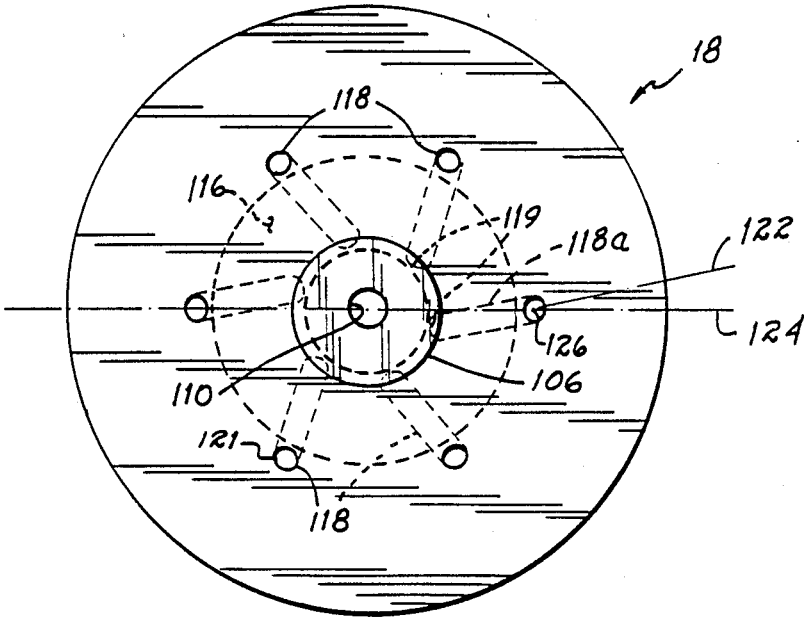
FIG. 3 is a top plan view of the nozzle attachment shown in FIG. 2.

Referring now to the bottom of FIG. 1 and to FIGS. 2 and 3, one embodiment of the nozzle attachment 18 of this invention is shown in detail. The nozzle attachment 18 is an annular plate having one side formed with a first or inner surface 102 and an opposite side formed with a second or outer surface 104 spaced from the inner surface 102. For purposes of the present description, the term "inner" refers to a direction toward the nozzle 14, and the term "outer" refers to a direction away from the nozzle 14 with the nozzle attachment 18 mounted to the nozzle 14 as shown in FIG. 1.

A boss 106 extends outwardly from the inner surface 102, and a nozzle tip 108 extends inwardly from the outer surface 104 in alignment with the boss 106. A throughbore 110 is drilled in the nozzle attachment 18 between the boss 106 and nozzle tip 108 forming a discharge outlet 109 in the nozzle tip 108 which is coplanar with the outer surface 104 of nozzle attachment 18. The throughbore 110 has a diameter in the range of about 0.010 to 0.040 inches, and preferably in the range of about 0.0175 to 0.0185 inches.

An annular, substantially V-shaped groove 112 is formed in the nozzle attachment 18 which extends inwardly from its outer surface 104 toward the inner surface 102. The annular groove 112 defines a pair of sidewalls 114, 116 which are substantially perpendicular to one another and intersect. In a presently preferred embodiment, the sidewall 116 is formed at approximately a 30° angle with respect to the planar outer surface 104 of the nozzle attachment 18, and the sidewall 114 forms the outer surface of the nozzle tip 108. As best shown in FIGS. 2 and 3, six air jet bores 118 are formed in the nozzle attachment 18 between the annular groove 112 and the inner surface 102, preferably at an angle of approximately 30° with respect to the longitudinal axis of the throughbore 110. The diameter of the air jet bores 118 is in the range of about 0.010 to 0.040 inches, and preferably in the range of about 0.017 to 0.019 inches.

The annular groove 112 facilitates accurate drilling of the air jet bores 118 so that they are formed at the desired angle relative to throughbore 110 and are precisely located at the desired position along the sidewall 116 of groove 112. By forming the sidewall 116 at a 30° angle relative to the upper surface 102 of nozzle attachment 18, a drill bit (not shown) can enter the annular groove 112 in the nozzle attachment 18 at a 30° angle relative to its outer surface 104, but contact the sidewall 116 formed by the annular groove 112 at a 90° angle. As a result, the drilling operation is performed with minimal slippage between the drill bit and nozzle attachment 18. This allows the outlet 119 of the air jet bores 118 to be precisely positioned at the sidewall 116 and oriented at the appropriate angles relative to throughbore 110. In the event of any drift of the drill bit as it moves through the nozzle attachment 18 to the inner surface 102, the inlet 121 of the air jet bores 118 may be slightly out of position but would nevertheless intersect the annular chamber 95 formed in nozzle 14.

As shown in FIG. 3, the longitudinal axis of each of the air jet bores 118 is angled approximately 10° with respect to a vertical plane passing through the longitudinal axis of the throughbore 110 and the center of each such bore 118 at the annular groove 112. For example, the longitudinal axis 122 of air jet bore 118*a* is angled approximately 10° relative to a vertical plane passing through the longitudinal axis 124 of throughbore 110 and the center point 126 of bore 118*a* at the annular groove 112 in nozzle attachment I8. As a result, the jet of pressurized air 128 ejected from air jet bore 118*a* is directed substantially tangent to the outer periphery of the throughbore 110 and the adhesive bead 130 ejected therefrom, as described below.

Figure 4:
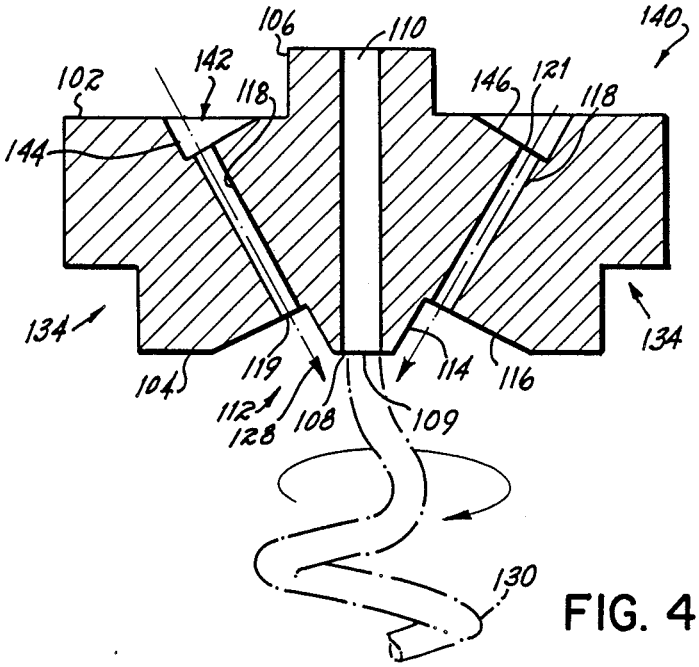
FIG. 4 is an enlarged cross sectional view, similar to FIG. 2, of an alternative embodiment of the nozzle attachment of this invention.
Figure 5:
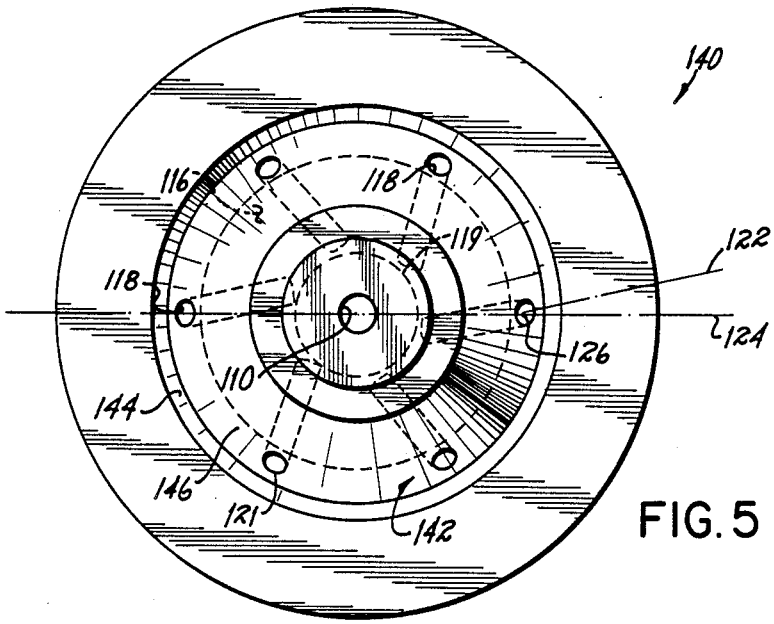
FIG. 5 is a top plan view of the nozzle attachment of FIG. 4.

Referring now to FIG. 4, an alternative embodiment of a nozzle attachment is illustrated. In this embodiment, a nozzle attachment 140 is provided which is identical to nozzle attachment 18 except for the addition in nozzle attachment 140 of a second annular groove 142. The second annular groove 142 extends from the inner surface 102 toward the outer surface 104 of the nozzle plate and intersects the inlets 121 of each of the air jet bores 118. The annular groove 142 is illustrated in FIG. 4 as substantially V-shaped having sidewalls 144 and 146. It has been found that this second annular groove 142 enhances the passage of pressurized air from the annular air chamber 95 at the base of nozzle 14 into the inlet 121 of each air jet bore 118. This ensures that the adhesive bead 130 ejected from the throughbore 110 in nozzle attachment 140 is attenuated or stretched to form an elongated adhesive fiber and that such fiber is imparted with a twisting motion for deposition in a spiral pattern upon the substate.

Referring now to FIGS. 1 and 2, the cap 62 is formed with an annular seat 132 which mates with an annular recess 134 formed in the peripheral edge of nozzle attachment 18 which extends inwardly from its outer surface 104. The cap 62 is threaded onto the lowermost end of the nozzle 14 so that the boss 106 on the inner surface 102 of nozzle attachment 18 extends within a seat 136 formed in the base of nozzle 14 at the adhesive discharge opening 57 of adhesive passageway 56. With the nozzle attachment 18 in this position, the inlet of each of the air jet bores 118 communicates with the annular air chamber 95 formed in the base of the nozzle 14 at the end of the air delivery passageway 94. No 0-rings or other seals are required between the inner surface 102 of the nozzle attachment 18 and the nozzle 14 in order to create a fluid-tight seal therebetween and between the boss 106 and adhesive discharge opening 57. The nozzle attachment 18 is easily removed and replaced by another attachment of different size by rotating the cap 62 out of engagement with the nozzle 14. Nozzle attachment 140 is secured to nozzle 14 in the same manner.

The operation of the dispensing device 10 of this invention is as follows. Heated hot melt adhesive is introduced into the adhesive cavity 46 of the gun body 12 through the adhesive inlet line 84. Adhesive flows from the adhesive cavity 46 into the nozzle 14 through the adhesive passageway 56. With the terminal end 59 of the plunger 22 in engagement with the seat 58 formed at the end of the adhesive passageway 56, as illustrated in FIG. 1, the adhesive is not permitted to flow through the adhesive discharge opening 57 of the adhesive passageway 56 to the throughbore 110. In order to retract the plunger 22 and permit the flow of adhesive into the discharge opening 57, operating air is introduced through the operating air line 88 into the air cavity 20 in the gun body 12. This pressurized air acts against the seal 24 connected to the plunger 22 which forces the plunger 22 upwardly so that its terminal end 59 disengages the seat 58 at the lower end of the adhesive passageway 56. The plunger 22 is returned to its closed position by discontinuing the flow of air to the air cavity 20 allowing the return spring 34 to move the plunger 22 back into a seated position.

The flow of hot melt adhesive through the adhesive discharge opening 57 of adhesive passageway 56 is transmitted into the throughbore 110 of nozzle attachment 18 or 140 from which it is discharged through the discharge outlet 109 of nozzle tip 108 to form the adhesive bead 130. At the same time the adhesive bead 130 is formed and ejected from the nozzle attachment 18, pressurized air is directed through the air inlet line 92, air delivery passageway 94 and air chamber 95 and into the inlet 121 of each air jet bore 118 formed in the nozzle attachment 18. In the embodiment of FIG. 4, the air flow is directed from the air chamber 95 into the annular groove 142 and then into the inlet 121 of each air jet bore 118, which, as mentioned above, improves the air flow characteristics of nozzle attachment 140.

As best shown in FIG. 2, the air jet bores 118 are angled relative to the longitudinal axis of the throughbore 110 so that the jets of air 128 flowing therethrough impact the adhesive bead 130 substantially tangent to its outer periphery at a point spaced below the nozzle tip 108. The air ejected from the air jet bores 118 performs two functions. First, the jets of air 128 attenuate or stretch the adhesive bead 130 forming an elongated strand or fiber of hot melt adhesive for deposition onto a substrate. Additionally, since the air jet bores 118 are oriented to direct jets of air 128 tangent to the outer periphery of the adhesive bead 130, the adhesive fiber formed therefrom are rotated in a compact spiral path toward a substrate. As a result, a controlled pattern of adhesive having a desired width is obtained on the substrate.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A nozzle attachment for use in an apparatus for dispensing adhesive which includes a gun body having a nozzle formed with an adhesive passageway for conveying adhesive and an air delivery passageway for conveying pressurized air, said nozzle attachment comprising:

a plate formed with a first surface on one side of said plate, and a second surface on an opposite side of said plate;

a nozzle tip formed in said plate which extends inwardly from said second surface toward said first surface, said nozzle tip having an outer surface and a discharge outlet located in substantially the same plane as said second surface of said plate;

said plate being formed with a throughbore extending between said first surface and said discharge outlet of said nozzle tip, said plate being adapted to mount to said nozzle of said gun body so that said throughbore communicates with said adhesive passageway in said nozzle for receiving adhesive, the adhesive being transmitted through said throughbore and being ejected from said discharge outlet in said nozzle tip to form an adhesive bead;

said plate being formed with an annular groove extending inwardly from said second surface toward said first surface, said annular groove having a first portion which forms said outer surface of said nozzle tip and a second portion which slopes relative to said throughbore in said plate;

said plate being formed with a plurality of air jet bores extending from said annular groove through said plate, said plate being adapted to mount to said nozzle so that said each of air jet bores communicates with said air delivery passageway in said nozzle for transmitting air therethrough, said air jet bores each having a longitudinal axis extending substantially perpendicular to said second portion of said annular groove, said air jet bores being formed at an angle with respect to said throughbore in said plate to direct pressurized air flowing therethrough substantially tangent to the outer periphery of said adhesive bead ejected from said adhesive discharge outlet of said nozzle tip to form said adhesive bead in an elongated adhesive fiber and to impart a twisting motion to said elongated adhesive fiber for deposition in a spiral spray pattern on a substrate.

2. The nozzle attachment of claim 1 in which said air jet bores in said annular plate are formed at an angle of about 30° relative to the longitudinal axis of said throughbore in said plate.

3. The nozzle attachment of claim 1 in which the longitudinal axis of each said air jet bores forms an angle of approximately 10° relative to a vertical plane passing through the longitudinal axis of said throughbore, the pressurized air ejected from said air jet bores thereby being directed substantially tangent to the outer periphery of said adhesive bead ejected from said discharge outlet in said nozzle tip.

4. A nozzle attachment for use in an apparatus for dispensing adhesive which includes a gun body having a nozzle formed with an adhesive passageway for conveying adhesive and an air delivery passageway for conveying pressurized air, said nozzle attachment comprising:

an annular plate formed with a first surface on one side of said plate, and a second surface on an opposite side of said plate;

a nozzle tip formed in said plate which extends inwardly from said second surface toward said first surface, said nozzle tip having an outer surface and a discharge outlet located in substantially the same plane as said second surface of said plate;

said plate being formed with a throughbore extending between said first surface and said discharge outlet of said nozzle tip, said plate being adapted to mount to said nozzle of said gun body so that said throughbore communicates with said adhesive passageway in said nozzle for receiving adhesive, the adhesive being transmitted through said throughbore and being ejected from said discharge outlet of said nozzle tip to form an adhesive bead;

said plate being formed with a first annular groove extending inwardly from said second surface toward said first surface, said first annular groove having a first portion which forms said outer surface of said nozzle tip and a second portion which slopes relative to said throughbore in said plate, said plate being formed with a second annular groove extending inwardly from said first surface toward said second surface;

said plate being formed with a plurality of air jet bores extending through said plate having an inlet at said second annular groove and an outlet at said first annular groove, said plate being adapted to mount to said nozzle so that said inlet of each said air jet bores communicates with said air delivery passageway in said nozzle for transmitting air therethrough, said air jet bores each having a longitudinal axis extending substantially perpendicular to said second portion of said first annular groove, said air jet bores being formed at an angle with respect to said throughbore in said plate to direct pressurized air flowing therethrough substantially tangent to the outer periphery of said adhesive bead ejected from said adhesive discharge outlet of said nozzle tip to form said adhesive bead in an elongated adhesive fiber and to impart a twisting motion to said elongated adhesive fiber for deposition in a spiral spray pattern on a substrate.

5. The nozzle attachment of claim 4 in which said second annular groove is substantially V-shaped having sidewalls which extend from said first surface toward said second surface and intersect one another.

6. Apparatus for spraying hot melt adhesive, comprising:

a gun body having a nozzle formed with an adhesive passageway communicating with a source of adhesive and an air passageway communicating with a source of pressurized air;

a plate formed with a boss extending outwardly from a first surface of said plate and a nozzle tip extending inwardly from a second surface of said plate toward said first surface, said nozzle tip having an outer surface and a discharge outlet located in substantially the same plane as said second surface of said plate, said plate being formed with a throughbore extending between said boss and said discharge outlet of said nozzle tip;

said plate being formed with an annular groove extending inwardly from said second surface toward said first surface, said annular groove having a first portion which forms said outer surface of said nozzle tip and a second portion which slopes relative to said throughbore in said plate;

said plate being formed with a plurality of air jet bores extending from said annular groove through said plate, said air jet bores each having a longitudinal axis extending substantially perpendicular to said second portion of said annular groove and at an angle relative to the longitudinal axis of said throughbore in said plate;

cap means for mounting said plate to said nozzle of said gun body so that said throughbore formed between said boss and said discharge outlet in said nozzle tip communicates with said adhesive passageway in said nozzle and so that said air jet bores communicate with said air passageway in said nozzle, said throughbore receiving adhesive from said adhesive passageway and ejecting the adhesive from said discharge outlet in said nozzle tip to form an adhesive bead, said air jet bores receiving pressurized air from said air passageway in said nozzle and directing the pressurized air substantially tangent to the outer periphery of said adhesive bead to form an elongated adhesive fiber and to impart a twisting motion to said elongated adhesive fiber to form a spiral spray pattern of the elongated adhesive fiber for deposition on a substrate.

7. The apparatus of claim 6 in which said nozzle of said gun body is formed with a seat which receives said boss of said plate forming a fluid-tight seal therebetween.

8. The apparatus of claim 6 in which said plate is annular and has a peripheral edge formed with a recess which extends from said second surface toward said first surface of said plate.

9. The apparatus of claim 8 in which a portion of said nozzle of said gun body is formed with external threads, said cap means comprising a cylindrical-shaped member formed with a throughbore defining an inner wall having threads adapted to mate with said external threads of said nozzle, said cylindrical-shaped member being formed with an annular seat which mates with said recess formed in said annular plate to support said plate, said cylindrical-shaped member being threaded onto said nozzle to place said throughbore of said plate in communication with said adhesive passageway in said nozzle.

10. The apparatus of claim 6 in which said plate is formed with a second annular groove extending inwardly from said first surface toward said second surface and intersecting one end of each of said air jet bores.

11. Apparatus for spraying hot melt adhesive, comprising:

a gun body having a nozzle formed with an adhesive passageway communicating with a source of adhesive and an air passageway communicating with a source of pressurized air;

a plate formed with a boss extending outwardly from a first surface of said plate and a nozzle tip extending inwardly from a second surface of said plate toward said first surface, said nozzle tip having an outer surface and a discharge outlet located in substantially the same plane as said second surface of said plate, said plate being formed with a throughbore extending between said boss and said discharge outlet of said nozzle tip;

said plate being formed with a first annular groove extending inwardly from said second surface toward said first surface, said first annular groove having a first portion which forms said outer surface of said nozzle tip and a second portion which slopes relative to said throughbore in said plate, said plate being formed with a second annular groove which extends inwardly from said first surface toward said second surface;

said plate being formed with a plurality of air jet bores extending through said plate having an inlet at said second annular groove and an outlet at said first annular groove, said air jet bores each having a longitudinal axis extending substantially perpendicular to said second portion of said first annular groove and at an angle relative to the longitudinal axis of said throughbore in said plate;

cap means for mounting said plate to said nozzle of said gun body so that said throughbore formed between said boss and said discharge outlet in said nozzle tip communicates with said adhesive passageway in said nozzle and so that said second annular groove and said air jet bores communicate with said air passageway in said nozzle, said throughbore receiving adhesive from said adhesive passageway and ejecting the adhesive from said discharge outlet in said nozzle tip to form an adhesive bead, said air jet bores receiving pressurized air from said air passageway in said nozzle through said second annular groove and directing the pressurized air substantially tangent to the outer periphery of said adhesive bead to form an elongated adhesive fiber and to impart a twisting motion to said elongated adhesive fiber to form a spiral spray pattern of the elongated adhesive fiber for deposition on a substrate.

* * * * *